United States Patent [19]

Mrenna

[11] 3,959,754

[45] May 25, 1976

[54] CIRCUIT BREAKER WITH IMPROVED TRIP MEANS

[75] Inventor: Stephen A. Mrenna, Beaver, Pa.

[73] Assignee: Westinghouse Electric Corporation, Pittsburgh, Pa.

[22] Filed: Sept. 25, 1974

[21] Appl. No.: 509,169

[52] U.S. Cl. ..... 335/35; 335/37

[51] Int. Cl.[2] ..... H01H 75/12

[58] Field of Search ..... 335/23, 35, 36, 37

[56] References Cited

UNITED STATES PATENTS

| | | | |
|---|---|---|---|
| 3,110,786 | 11/1963 | Gelzheiser | 335/37 |
| 3,200,217 | 8/1965 | Bullis, Jr. | 335/36 |
| 3,213,249 | 10/1965 | Ellsworth et al. | 335/37 X |
| 3,278,707 | 10/1966 | Klein | 335/35 X |

*Primary Examiner*—G. Harris

*Attorney, Agent, or Firm*—W. A. Elchik

[57] ABSTRACT

An improved circuit breaker comprises a thermal trip that comprises a current carrying bimetal, and a magnetic trip that comprises a magnetic yoke and armature supported on the bimetal with a multi-turn energizing coil supported on the yoke to enhance the magnetic tripping action.

4 Claims, 3 Drawing Figures

FIG. 1.
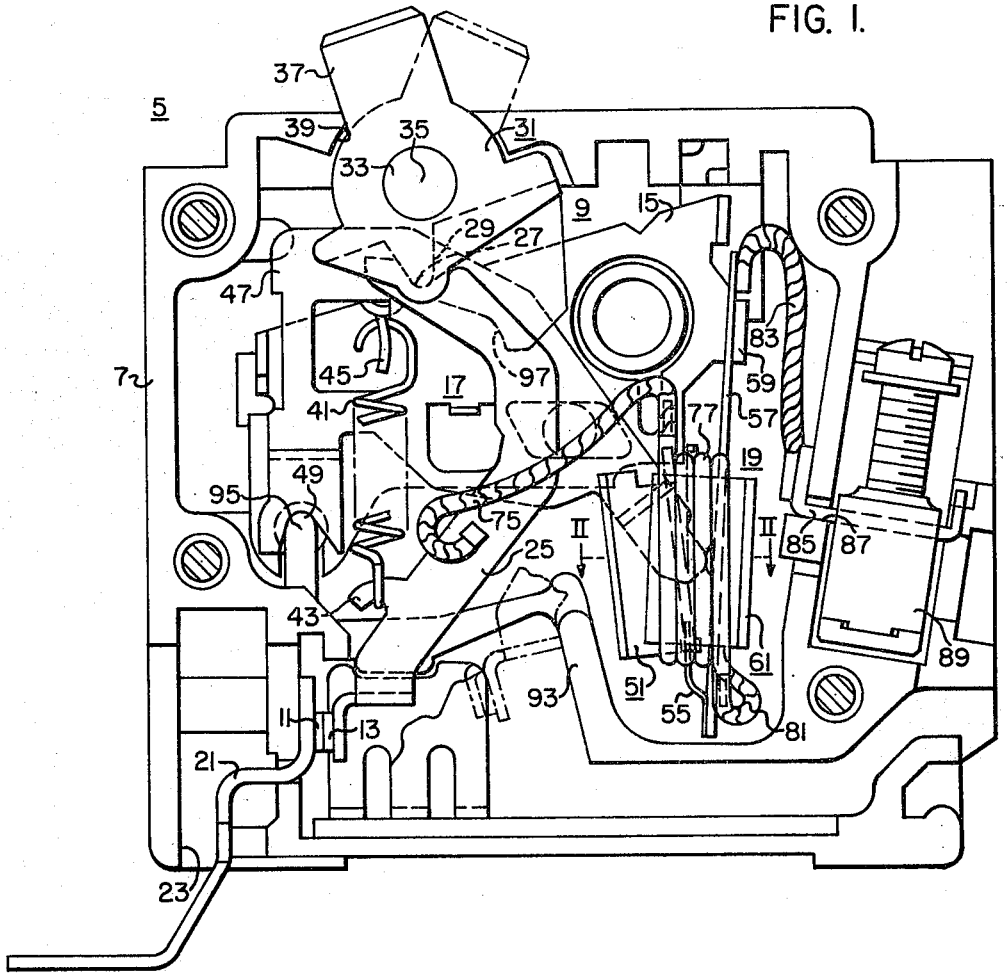
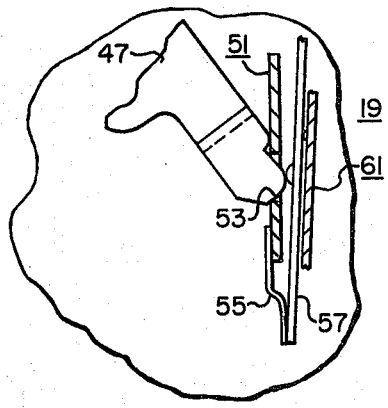
FIG. 3.
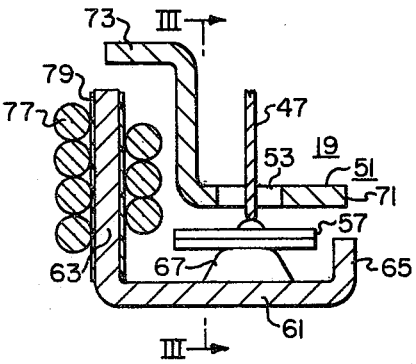
FIG. 2.

CIRCUIT BREAKER WITH IMPROVED TRIP MEANS

BACKGROUND OF THE INVENTION

1. Field of the Invention

Circuit breakers of the type comprising a bimetal thermal type trip for time-delay tripping operations and an electro-magnetic type trip for instantaneous tripping operations.

2. Description of the Prior Art

In the patent to Bullis, Jr. U.S. Pat. No. 3,200,217 there is disclosed a circuit breaker of the general type herein disclosed, with a bimetal thermal trip and an electro-magnetic trip comprising a magnetic yoke and armature supported on the current carrying bimetal.

In the patent to Ellsworth et al, U.S. Pat. No. 3,071,666 there is disclosed a circuit breaker comprising a bimetal thermal type trip and an electro-magnetic trip that comprises a magnetic yoke supported on the bimetal with a multi-turn energizing coil supported on the magnetic yoke.

SUMMARY OF THE INVENTION

The circuit breaker of this invention comprises an insulating housing and a circuit-breaker mechanism supported within the housing. The mechanism comprises a pair of cooperable contacts and a latched releasable member releasable to effect automatic opening of the contact. A thermal trip comprises a current carrying bimetal that flexes with a time delay upon the occurrence of lesser overload current conditions to effect release of the releasable member. An electro-magnetic trip comprises a magnetic yoke fixedly supported on the bimetal and a magnetic armature supported on the bimetal for movement relative to the yoke. A multi-turn energizing coil is supported on an elongated leg of the magnetic yoke. Upon the occurrence of higher overload current conditions above a predetermined value the armature is attracted to the yoke to effect release of the releasable member to thereby provide an instantaneous electro-magnetic tripping operation.

BRIEF DESCRIPTION OF THE DRAWINGS

FIG. 1 is a side sectional view of a circuit breaker embodying principles of this invention;

FIG. 2 is a partial sectional view taken generally along the line II—II of FIG. 1; and FIG. 3 is a partial sectional view taken generally along the line III—III of FIG. 2.

DESCRIPTION OF THE PREFERRED EMBODIMENT

Referring to FIG. 1 of the drawing, there is disclosed therein a circuit breaker 5 comprising an insulating housing 7 and a circuit-breaker mechanism 9 supported in the housing 7. The circuit-breaker mechanism 9 comprises a stationary contact 11, a movable contact 13, a supporting metal frame 15, an operating mechanism 17 and a thermal and magnetic trip means 19.

The stationary contact 11 is supported on a conducting terminal 21 that extends out through an opening 23 in the bottom of the housing. The movable contact 13 is supported on one end of a contact arm 25. The contact arm 25 is provided with a depression or bearing surface 27 at its upper end that receives a generally V-shaped bearing part 29 of an insulating operating member 31. The operating member 31 is provided with a pair of molded bearing pins 33 at its opposite sides which fit into suitable openings in the insulating housing 7 to pivotally support the operating member 31 for movement about an axis indicated at 35. The operating member 31 is provided with a handle part 37 that extends our through an opening 39 in the front of the housing to permit manual operation of the circuit breaker. An over center tension spring 41 is supported at its lower end on a projection 43 of the contact arm 25 and at its upper end on a projection 45 of a releasable trip member 47. The releasable trip member 47 is pivotally supported at one end thereof on a molded portion 49 of the insulating housing 7. The releasable trip member 47 is latched at its other end on a magnetic armature 51. As is best seen in FIGS. 2 and 3, the armature 51 is provided with a window opening therein having a latch surface 53 at the lower ledge of the window opening. The releasable member 47 engages the latch surface 53 (FIGS. 1–3) and the latched position of the releasable member. As is best seen in FIG. 3, the armature 51 is supported on a leaf spring 55 that is in turn supported on a bimetal 57 whereby the armature 51 is movably supported on a bimetal 57. The bimetal 57 (FIG. 1) is fixedly supported at its upper end on a bent-over projection 59 of the supporting frame 15. A generally U-shaped magnetic yoke 61, comprising a long leg 63 and a short leg 65 (FIG. 2) is fixedly supported on the bimetal 57 by means of a weld 67. As can be understood with reference to FIG. 2, the armature 51 is generally Z-shaped with a lower leg 71 having the window opening therein and having a portion disposed opposite the short leg 65 of the yoke 61 and with an upper leg 73 having a portion disposed opposite the long leg 63 of the yoke 61. A flexible conductor 75 (FIG. 1) is connected at one end thereof to the contact arm 25 and at the other end thereof to a coil 77 that provides a plurality of turns around the long leg 63 of the magnetic yoke 61. The coil 77 is provided with a thin layer of insulation to insulate the turns from each other and the coil is also insulated from the leg 63 of the magnetic yoke by means of an insulating member 79 that is disposed between the coil 77 and the leg 63. A flexible conductor 81 (FIG. 1) is secured at one end thereof to the other end of the coil 77 and at the other end thereof to the bottom of the bimetal 57. Another flexible conductor 83 is secured at one end thereof to the top of the bimetal 57 and at the other end thereof to a conductor 85 that protrudes through an opening 87 in the housing and to which is secured a solderless terminal connector 89 that will receive a conductor at a installation to enable connection of a conducting wire to the circuit breaker.

The circuit through the breaker extends from the terminal conductor 21 through the stationary contact 11, movable contact 13, contact arm 25, flexible conductor 75, coil 77, flexible conductor 81, bimetal 57, flexible conductor 83, conductor 85, to a conductor that would be connected to the breaker by means of the solderless terminal connector 89 at an installation.

With the releasable member 47 in the latched position shown in FIGS. 1–3, the circuit breaker may be manually operated to open and close the contacts by operation of the operating handle 37 of the insulating operating member 31. Movement of the handle 37 clockwise from the full line position shown in FIG. 1 to the position in which it is shown in dot-and-dash lines carries the upper end of the contact arm 25 to the left of the line of action of the spring 41 whereupon the spring 41 acts to move the contact arm 25 with a snap action to the open position shown partially in dot-and-dash lines in FIG. 1. A projection 93 molded integral with the housing 7 acts as a limit stop for the movable contact arm 25 during opening operations. Movement of the handle 37 in a counterclockwise direction from the position shown in dot-and-dash lines in FIG. 1 to the full line position moves the upper end of the contact arm 25 to the right of the line of action of the spring 41 which spring thereupon acts to move the contact arm to the closed position with a snap action.

Upon the occurrence of a sustained lesser overload current above a first predetermined value, the bimetal 57 becomes heated and deflects to the right to effect a time delayed thermal tripping operation. The armature 51, which is supported on the bimetal 57 by means of the spring 55, is carried to the right with the bimetal to release the releasable member 47. When the releasable member 47 is released, the spring 41 acts to rotate the releasable member clockwise on the post 49 about an axis indicated at 95 until this motion is arrested by engagement of the releasable member 47 with the molded part 93 of the insulating housing 7. During this movement, the spring 41 moves the contact arm 25 to the open position and the operating member 31 to a position intermediate the "on" and "off" positions to provide a visual indication that the circuit breaker has tripped open.

Before the contacts can be closed following an automatic tripping operation it is necessary to reset and relatch the mechanism. This is accomplished by moving the operating handle 37 clockwise from the intermediate position to a position slightly beyond the full open or "off" position. During this movement, due to the engagement of a downwardly extending portion 97 of the operating member 31 with the bent-over projection 45 of the releasable member 47, the releasable member 47 is moved counterclockwise about the axis 95 until the end of the releasable member 47 is again latched in the window opening on the latch surface 53 (FIGS. 2 and 3) of the armature 51. Following a resetting operation the circuit breaker can be manually operated in the same manner as was hereinbefore described.

The circuit breaker is magnetically tripped automatically and instantaneously in response to overload currents above a second predetermined value higher than the first predetermined value. As was hereinbefore described, the circuit through the circuit breaker extends through the turns of the coils 77 around the long leg 63 of the magnetic yoke 61 and the current through the bimetal 57 provides an additional turn. Upon the flow of the excess overload current through the coil 77 and bimetal 57 the magnetic flux, which is induced around the conductor 77 and bimetal 57, takes the path of least reluctance through the magnetic yoke 61, across the air gaps between the ends of the legs 63, 65 and the armature 51. When an overload current above the second predetermined value occurs, the pull of the magnetic flux is of such strength that the armature 51 is instantaneously attracted to the yoke 61 whereupon the spring 55 flexes permitting the armature to move to the right to release the releasable member 47 whereupon the circuit breaker is tripped open in the same manner as was hereinbefore described with regard to the thermal tripping operation. Following a magnetic tripping operation the circuit breaker is reset and relatched in the same manner as was hereinbefore described.

From the foregoing, it can be understood that there is provided by this invention an improved circuit breaker comprising thermal-magnetic trip means that comprises a current carrying bimetal, a magnetic yoke and armature supported on the bimetal and a multi-turn energizing coil supported on the yoke to enhance the magnetic trip action of the trip means. The yoke is generally U-shaped provided with a long leg and a short leg, and the armature is generally Z-shaped to provide that parts of the armature are disposed opposite the pole faces or ends of the long and short legs of the magnetic yoke. One of the legs of the generally Z-shaped armature is provided with a window opening to latch the releasable member in the reset or latched position of the mechanism.

I claim:

1. A circuit breaker comprising a pair of cooperable contacts, a latched releasable member releasable to effect automatic opening of said contacts, trip means comprising an elongated bimetal supported in proximity to one end thereof, a magnetic yoke fixedly supported on said bimetal, said yoke being generally U-shaped and comprising a long leg and a short leg, a magnetic armature supported on said bimetal for movement relative to said yoke, said armature comprising an intermediate part and two armature legs extending from the opposite ends of said intermediate part generally transverse to said intermediate part in opposite directions from each other, a first of said armature legs being opposite the end of said long leg of said yoke and the second of said armature legs being opposite the end of said short leg of said yoke, a multi-turn coil around said long leg of said yoke and carrying the current through said breaker, said multi-turn coil being connected in electrical series with said bimetal, upon the occurrence of a sustained overload current above a first predetermined value said bimetal flexing to effect release of said releasable member, and upon the occurrence of an overload current above a second predetermined value said armature being attracted to said yoke and moving to effect release of said releasable member.

2. A circuit breaker according to claim 1, and a leaf spring secured to said armature and said bimetal to resiliently support said armature on said bimetal.

3. A circuit breaker according to claim 1, and a latch part on said second armature leg engaging said releasable member to latch said releasable member in the latched position of said releasable member.

4. A circuit breaker according to claim 3, and a leaf spring connected to said armature and said bimetal to resiliently support said armature on said bimetal.

* * * * *